US007738802B2

(12) United States Patent
Spence et al.

(10) Patent No.: US 7,738,802 B2
(45) Date of Patent: Jun. 15, 2010

(54) DYNAMIC ESV (SENSOR) POSITIONER FOR MULTI-COLOR CONFIGURATION

(75) Inventors: James J. Spence, Honeoye Falls, NY (US); Michael J. Martin, Hamlin, NY (US); Michael B. Monahan, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 11/961,568

(22) Filed: Dec. 20, 2007

(65) Prior Publication Data

US 2009/0162083 A1 Jun. 25, 2009

(51) Int. Cl.
*G03G 15/00* (2006.01)

(52) U.S. Cl. ..... 399/49

(58) Field of Classification Search ..... 399/49, 399/73, 48, 227; 400/157; 358/474; 347/140
See application file for complete search history.

(56) References Cited

U.S. PATENT DOCUMENTS 2,843,243 A * 7/1958 Masterson ..... 400/157
3,998,538 A * 12/1976 Urso et al. ..... 399/73
4,748,465 A * 5/1988 Tsilibes et al. ..... 347/140
5,903,800 A * 5/1999 Stern et al. ..... 399/74
2003/0142996 A1* 7/2003 Hiroki ..... 399/227
2004/0156663 A1* 8/2004 Omata et al. ..... 399/400
2006/0188277 A1* 8/2006 Nishida et al. ..... 399/49
2006/0203300 A1* 9/2006 Choi ..... 358/474
2006/0263108 A1* 11/2006 Zona ..... 399/48

* cited by examiner

*Primary Examiner*—Quana M Grainger
(74) *Attorney, Agent, or Firm*—Oliff & Berridge, PLC

(57) ABSTRACT

A method and system for providing dynamic sensor positioning in a color image forming device. Movably mounted sensors are provided in color printers and color reproduction devices allowing for a single sensor to be utilized in a plurality of positions corresponding to a plurality of color control patches, resulting in reduced production and operating costs. In particular, a color xerographic device is provided with a movably mounted ESV that can be positioned substantially adjacent to a plurality of color control patches, thereby, allowing for a single ESV in a multi-color image forming device.

10 Claims, 4 Drawing Sheets

DYNAMIC ESV (SENSOR) POSITIONER FOR MULTI-COLOR CONFIGURATION

BACKGROUND

This disclosure is directed to systems and methods for defining a dynamic sensor positioner mechanism in an image forming device.

Printers, copiers and other types of image forming devices have become necessary productivity tools for producing and/or reproducing color documents. Such image forming devices include, but are not limited to, printers, desktop copiers, stand-alone copiers, scanners, facsimile machines, photographic copiers and developers, and multi-function devices and other like systems capable of producing and/or reproducing image data from an original document, data file or the like.

As the technology expands with respect to color image forming devices, the need for additional colors is increasing. For example, beyond the standard four colors of cyan, magenta, yellow and black (CMYK), the need for customized colors is increasing so that name brand colors, i.e., those colors associated with a specific sports team, commercial outlet, etc., are required. The need for increasing the ability to supply more colors in an image forming device is desirable to optimize overall cost performance and to minimize operational disruption. Similarly, as users become more dependent on producing and reproducing color documents, the need increases for quality color products that are customized to the particular needs of the customer, while minimizing operational costs and disruptions.

In color image forming devices, capabilities exist for increasing the number of colors an image forming device may contain, however, color printing requires a control color patch, for each individual color, which is laid down at each color station. The control color patches are utilized to ensure that the respective colors are laid down relative to each other to ensure optimal image quality. The patches are laid down in the inner document zone (JDZ), from inboard to outboard to accommodate the various colors. For every patch being laid down, an electrostatic voltage (ESV) sensor is required to be aligned over the patch in a multi-sensor configuration. Therefore, as the number of overall colors increases, so does the requirement for a corresponding number of sensors such as ESV sensors.

The requirement for increased color stations necessitates an ESV for each color station, resulting in complex manufacturing, and increased production and operating costs.

SUMMARY

A drawback to the conventional technology as discussed above, is the increased complexity and cost of operating and maintaining the plurality of sensors, where a single sensor may be required for a single application. Additionally, it is also anticipated that the expansion of the color selection and the need for the increased plurality of sensors, supports, etc., would necessarily result in an increase in the overall footprint of the image forming device. It should be considered that while the disclosed embodiments are described with respect to ESV sensors of color image forming devices, it should be appreciated that this is for illustration only and the methods and systems described herein may apply to any application where at least one sensor may be movably positioned among a plurality of desired locations.

It would be advantageous, in view of the above-identified problems, to provide methods and systems, within or related to one or more color image forming devices, that would allow the application of a single sensor that can be movably positioned. Therefore, a plurality of sensors would not be required, nor the associated supports, controls, operating system support, etc. and the overall cost and complexity of the image forming device could be reduced. For example, it may be advantageous to utilize ESV's different than a one-to-one relationship with respect to control color patches. For example, a single ESV is moveable between a plurality of control color stations, while being capable of full operation at each control color station, such as capable of measuring the electrostatic charge and density of each.

It should be appreciated that the systems and methods according to this disclosure may provide a system for positionally moving any type of carriage to which a sensor may be attached, between a plurality of stations, and being able to perform fully at each station. Additionally, it should be anticipated that the function performed at each station is not limited to measuring the electrostatic charge or density, i.e., different functions may be performed, and/or measured, at each of the plurality of stations. For example, parameter A may be measured at station I, and parameter B measured at station II, by the same sensor, on any other conceivable combination of actions known to one skilled in the art.

The systems and methods according to this disclosure may provide one or more sensor positioning mechanisms allowing for a sensor to translate in a linear fashion along a photoreceptor drum surface to be positioned adjacent to a plurality of color control patches.

The systems and methods according to this disclosure may provide a system controller that controls the linear movement of a carriage, to which a sensor may be mounted, with respect to a datum surface, such as a base plate and/or photoreceptor drum surface.

The systems and methods according to this disclosure may provide system sensors in communication with various components of the image forming device, either internal or external to the image forming device, to provide input to a system controller and/or determination unit.

The systems and methods according to this disclosure may provide a determination unit in communication with one or more sensors in an image forming device and with a system controller to make a determination regarding next steps in an image forming operation in the image forming device.

These and other features and advantages of the disclosed embodiments are described in, or apparent from, the following detailed description of various exemplary embodiments.

BRIEF DESCRIPTION OF THE DRAWINGS

Various exemplary embodiments of disclosed systems and methods will be described, in detail, with reference to the following figures, wherein.

DETAILED DESCRIPTION OF EMBODIMENTS

The following description of various exemplary embodiments of systems and methods for a dynamic sensor positioner in an image forming device may refer to and/or illustrate components of a color xerographic image forming device as one specific type of system for the sake of clarity and ease of depiction and description. However, it should be appreciated that, in various exemplary embodiments, a dynamic sensor positioner in an image forming device, as illustrated, for example, in the figures, with principles disclosed herein, as outlined and/or discussed below, can be equally applied to any known, or later-developed, system in which sensors are utilized to perform various functions between a plurality of stations, by being movably positioned between various positions. A dynamic sensor positioner system, in an image forming device according to the systems and methods of this disclosure may find applicability in any system in which sensors are used to perform various functions among a plurality of stations.

The systems and methods according to this disclosure provide a capability to employ various sensors in other than a one-to-one relationship with the measuring stations. i.e. control color patches. The capability incumbent in the disclosed systems and methods has as one of several objectives of reducing overall manufacturing costs, reduce the overall complexity of operation and reduce the operational costs of an image forming device.

One or more sensors may be movably positioned so as to be substantially aligned, or positioned adjacent to, a specific point. It should be appreciated that the actual sensors may be accomplished by either pre-existing, or specifically installed, multipurpose or dedicated, sensors. Additionally, it should be appreciated that these sensors are known in the art and will not be further discussed.

Figure 1:
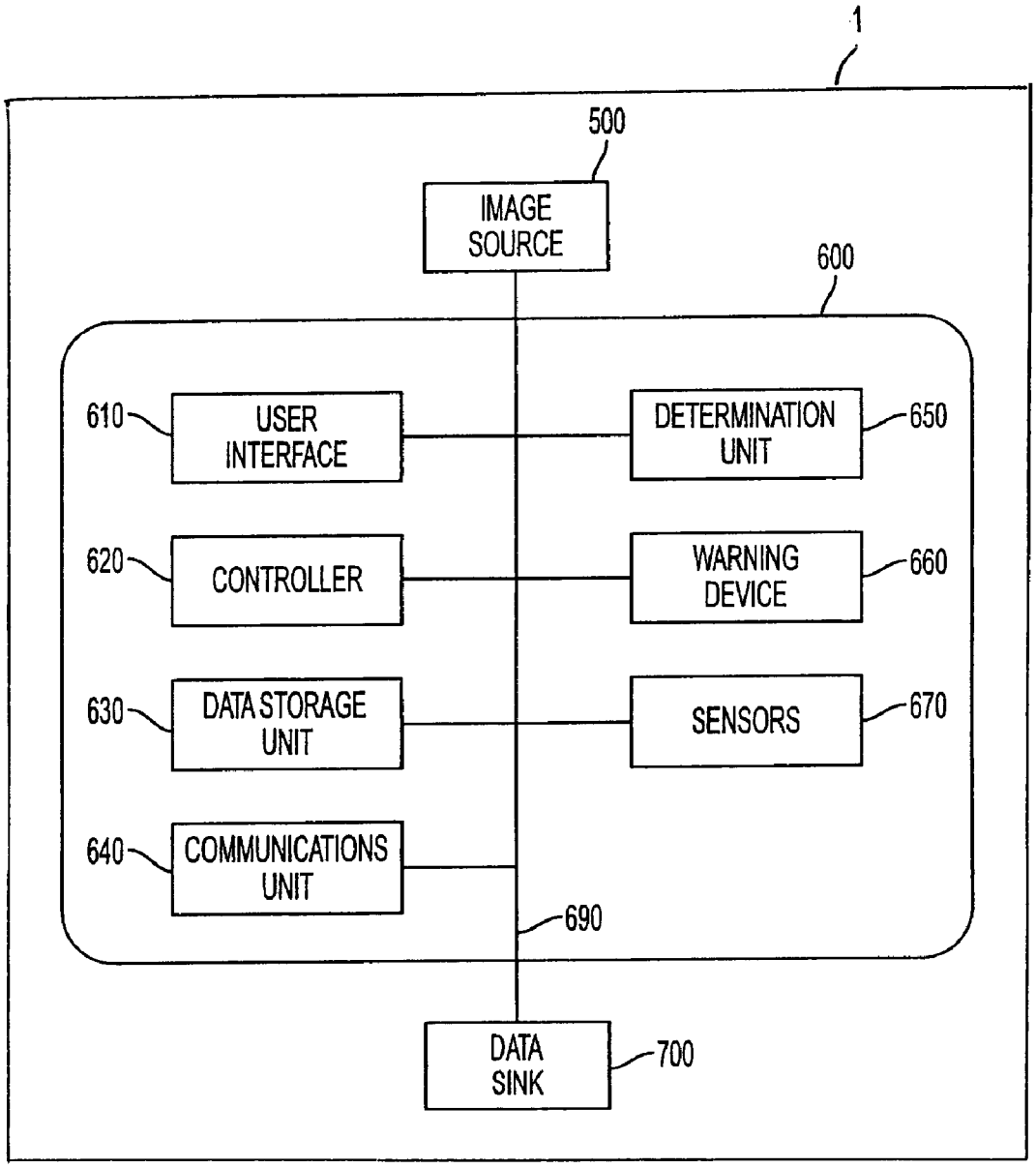
FIG. 1 illustrates a block diagram of an exemplary embodiment of a system for defining a dynamic ESV positioner in an image forming device.
Figure 2:
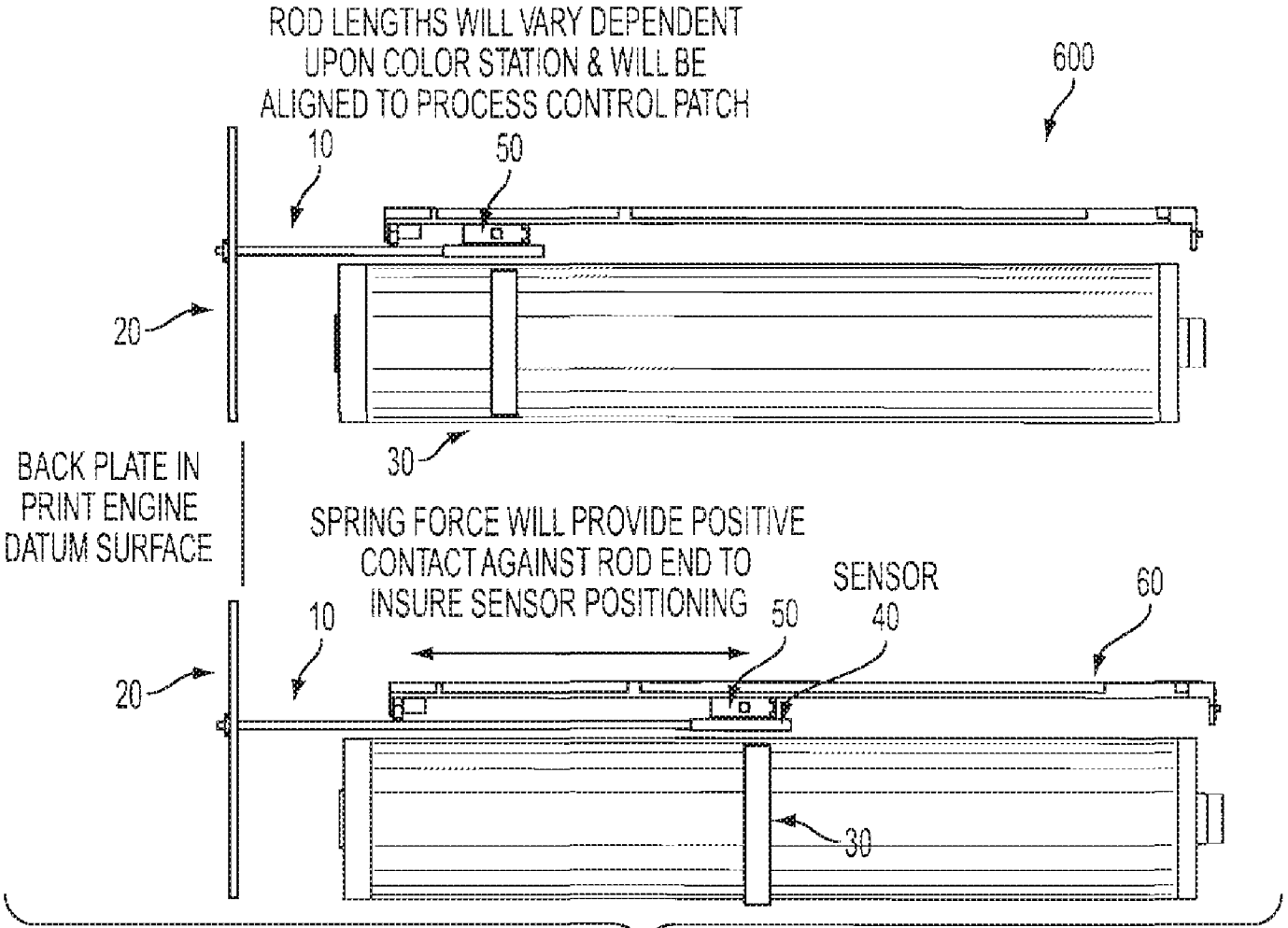
FIG. 2 illustrates an exemplary embodiment of a dynamic ESV positioner in an image forming device.

FIG. 1 illustrates a block diagram of an exemplary dynamic sensor positioner system 600 in a color image forming device 1 for movably positioning an ESV of the image forming device. As shown in FIG. 2, the exemplary system 600 may include an input interface 500, a user interface 610, a controller 620, a data storage unit 630, a communication unit 640, a determination unit 650, a warning device 660, one or more sensors 670, and a data sink 700, all connected via a main data/control bus 690. Such main data/control bus 690 may include one or more wired or wireless connections to any of the involved devices, units or modules.

The dynamic sensor positioner system 600 may include a user interface 610 in order that a user can enter, or be able to view, any instruction, to include an ability to movably position a sensor. It should be appreciated that the user interface 610 is contemplated to allow for presentation and receipt of user messages in a full spectrum of audio and/or visual formats. The user interface 610 may be in communication with the various system components by the main data/control bus 690, or otherwise by any means by which data communication between the user interface 610 and the other components of the dynamic sensor positioner system 600 or the image forming device may be implemented.

The dynamic sensor positioner system 600 may include a controller 620 in order to monitor the various operations of the dynamic sensor positioner system 600 within the image forming device in order to effect and/or facilitate execution of the dynamic sensor positioner system. The controller 620 may be in communication with the various system components by the main data/control bus 690, or otherwise by any means by which data communication between the controller 620 and the other components of the dynamic sensor positioner system 600 or the image forming device may be implemented.

The dynamic sensor positioner system 600 may include one or more determination units 650 used to compare various inputs from a variety of system components and to select appropriate methods of operation based on those determinations, as described above.

The determination unit 650 may be in communication with the various system components by the main data/control bus 690, or otherwise by any means by which data communication between the determination unit 650 and the other components of the dynamic sensor positioner system 600 or the image forming device may be implemented.

The dynamic sensor positioner system 600 may include one or more sensors 670 presented to provide input to the dynamic sensor positioner system 600 regarding, for example, a status of one or more ESV sensors, as described in the operation of the method above. The one or more sensors 670 may separately be located within the image forming device, and at other locations that are contemplated. The one or more sensors 670 may be in communication with the various system components by the main data/control bus 690, or otherwise by any means by which data communication between the one or more sensors 670 and the other components of the dynamic sensor positioner system 600 or the image forming device may be implemented.

The dynamic sensor positioner system 600 may include a communication unit 640 that is usable to communicate, receiving or transmitting, to local or remote users, additional image forming devices, or others systems. For example, the communications unit 640 may receive user input from a remotely-located user to the dynamic sensor positioner system 600; a user may be remotely located from the image forming device, and the user instructions, and graphical user interface menu prompts, warnings and messages, may utilize the communications unit to communicate the status of the dynamic sensor positioner system 600 to the user. It is contemplated that a local and remote user may have substantially the same interaction with the dynamic sensor positioner system 600 of the image forming device, independent of location. Such communication may be effected, via the communication unit 640, with any of the various components of the dynamic sensor positioner system 600 or otherwise associated with the image forming device. It is also contemplated that the dynamic sensor positioner system 600 may be employed in a system of a plurality of image forming devices.

It should be appreciated that communications may be undertaken with various components of the dynamic sensor positioner system 600, or otherwise in the image forming device with which the system 600 is associated, by either wired or wireless data exchange systems, as well as any combination thereof. Further, it should be appreciated that communications, as described above, are intended to include web-based network and local area network communications, in addition to remote, and/or local, operation from any manner of information or data exchange device such as, for example, personal computers and/or various other communication devices such as Personal Data Assistant's (PDA's), smart phones, and the like. The communication unit 640 and the communication interface 660 may be in communication with the various system components via the main data/control bus 690.

The dynamic sensor positioner system 600 may include a data storage unit 630 in order to allow for the retention of various operating parameters of the system 600. Such operating parameters may include, but are not limited to, the various sensor 670 inputs, pre-determined positions, user instructions received by any means, including the graphical user interface, and the status of the various determination units 650. It is contemplated that the operating parameters shall be stored within the data storage unit 630 until such time as the parameters are changed based on the systems and methods described relating to the dynamic sensor positioner system 600. The data storage unit 630 may be in communication with the various system components via the main data/control bus 690, or otherwise by any means by which data communication between the data storage unit 630 and the other components of the system 600 or the image forming device may be implemented.

Communication may occur between the controller 620 and the determination unit 650, upon initialization of the image forming device. The determination unit 650 detects the indication of a requirement to measure parameters associated with a predetermined position. For example, an ESV measuring the parameters associated with a color control patch. If the determination unit 650 determines that a sensor be movably positioned, then the determination unit 650 may communicate such a determination to the controller 620 which in turn may seek input from at least one sensor. For example, it may be beneficial to know the location of an ESV sensor with respect to a known datum or reference point. If the determination unit 650 does not determine that movement event is required or beneficial and that the exemplary dynamic sensor positioner system 600 has been initialized, then the determination unit 650, may be in communication with the controller 620, may allow the event to terminate.

It should be appreciated that the determination units 650 described above, may require some sensed input from various sensors 670 of the image forming device.

An exemplary embodiment of the tray usage policy system 600 may provide a warning device 660 that may be used to warn a user that the dynamic sensor positioner system requires attention. In such an instance, it may be advantageous to at least warn a user of the presence of a malfunction within the dynamic sensor positioner system in order to minimize operational downtime, user disruption, poor quality output, etc.

The warning device 660 may be used alternatively to warn a user, or otherwise, via some manner of graphical user interface 610 that the dynamic sensor positioner system has malfunctioned. It should be anticipated that warning devices associated with image forming devices are commonly known in the art and will not be further discussed here.

FIG. 2 illustrates an exemplary embodiment of a dynamic sensor positioner systems 600 where a rod 10 may extend out of a back plate 20 that may serve as a datum surface to control the alignment of the subsystems allowing proper image positioning on the image forming devices medium. A carriage 50, onto which a sensor 40 may be mounted (for example, an ESV sensor), may slide along a base 60 that controls the degree of movement of the carriage 50. It is anticipated that the rods may be positioned at all color stations and the lengths of the rods may be controlled to ensure sensor position relative to the color control patch 30. It is also anticipated that the application of the rods at each color station may be facilitated through the xerographic module. For example, when the xerographic module is pushed into the IOT, the sensor cartridge may load against the rod end and may be pushed into position at the end of the rod length when the xerographic module is seated or docked.

Figure 3:
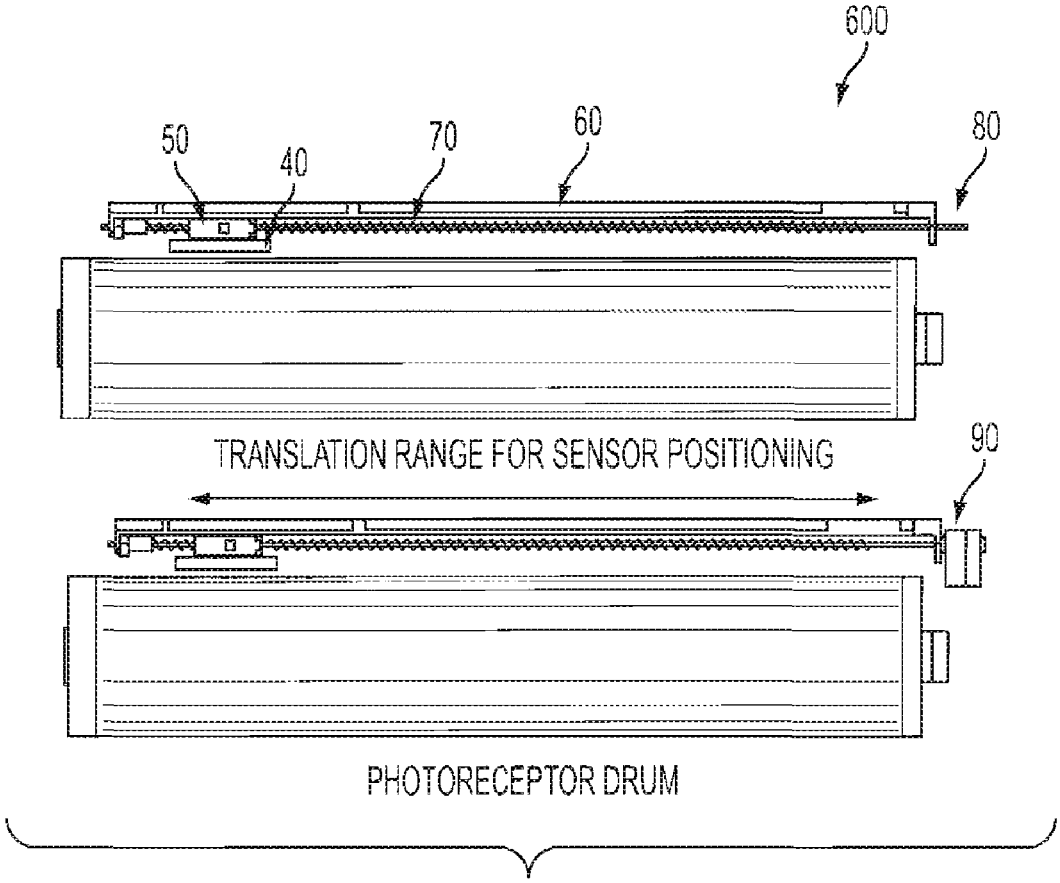
FIG. 3 illustrates an exemplary embodiment of a dynamic ESV positioner in an image forming device.

FIG. 3 illustrates an exemplary embodiment of a dynamic sensor positioner system 600 where the sensor 40 may be mounted on a carriage 50 that may travel linearly. The force to pull or push the carriage into position relative to a color control patch may be delivered by a shaft that may have a high pitched helix shaft 70 arrangement allowing for rapid positioning of a carriage 50 and/or sensor 40. The carriage 50 may travel along a base 60 that controls the degree of freedom of the movement of the carriage.

It is anticipated that the rotary motion of the high pitched helix shaft 70 arrangement may be delivered by either manual 80 operation of a user, whereby a user may manually position the carriage by manipulation of a knob or similar device, or the application of a servo motor 90 that will turn the shaft and move the carriage relative to the desired position. It is understood that the use of servo motor is well known in the art and will not be further discussed.

Figure 4A:
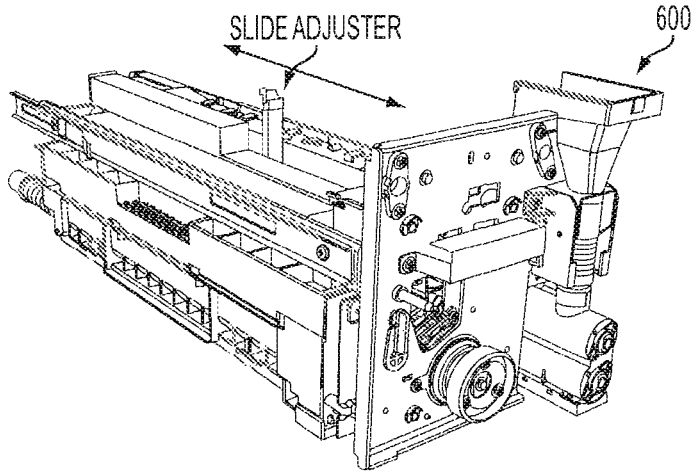
FIG. 4 illustrates an exemplary embodiment of a dynamic ESV positioner in an image forming device.
Figure 4B:
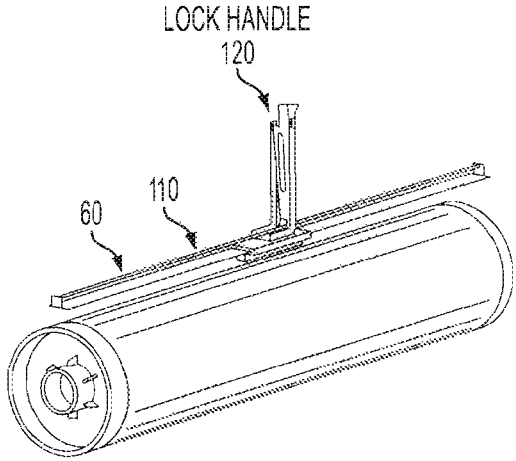
Figure 4C:
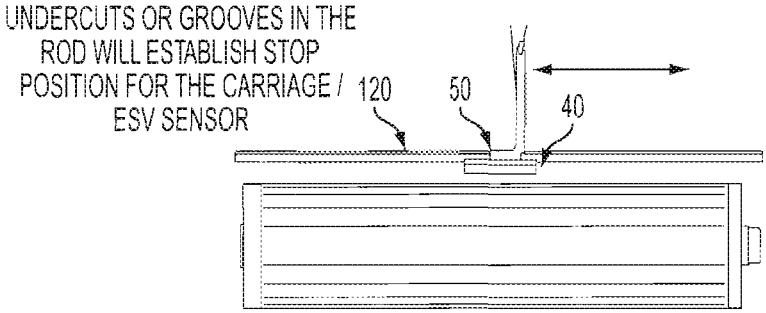

FIGS. 4A-4C illustrate an exemplary embodiment of a dynamic sensor positioner system 600 where the sensor 40 may be mounted onto a carriage 50 which may travel linearly. The carriage 50, on which a sensor 40 may be mounted, may be mounted between a front and rear plate of a xerographic module frame. It is also anticipated that there will be a guide rod 110 that may have grooves 120 at locations that may substantially correlate with a predetermined sensor alignment. For example, the grooves may substantially correlate to the positions of color control patches, or other such desired locations. The carriage 50 and sensor 40 may be positioned by applying a force to a handle 120 and pushing or pulling the handle until it clicks into the desired groove that substantially correlates to the desired position of the color control patch. For example, the movement of the carriage may be accomplished in a manner that is similar to the positioning of the paper guide of a feeder module of an image forming device.

It should be appreciated that, while shown in FIGS. 1-4C as a single composite unit internal to the exemplar dynamic sensor positioner system 600, the system 600 may be either a unit and, or capability internal to the image forming device, internal to any component of the image forming device, or may be separately presented as a stand-alone system, unit, or device such as, for example, a customer changeable unit enabling the user to rapidly remove the marking subsystem of the image forming device. Further, it should be appreciated that each of the individual elements depicted as part of the dynamic sensor positioner system 600 may be implemented as part of a single composite unit or as individual separate devices. For example, the determination unit 650, controller 620, and sensors 670 may be integral to a single composite unit communicating with other components of the overall system 600. Further, as noted above, it should be appreciated that, while depicted as separate units, the determination unit 650, controller 620, and sensors 670 may be separately attachable to the system as composite multi-function input/output components such as, for example, multi-function devices which include determination unit controller sensor capability all within a single unit with a user interface as part of the single composite unit.

It should be appreciated that given the required inputs, software algorithms, hardware circuits, and/or any combination of software and hardware control elements, may be used to implement the individual devices and/or units in the exemplary dynamic sensor positioner system 600.

It should be appreciated further that any of the data storage devices depicted in FIG. 1, or otherwise as described above, can be implemented using any appropriate combination of alterable, volatile or non-volatile memory, or non-alterable, or fixed, memory. The alterable memory, whether volatile or non-volatile can be implemented using any one or more of static or dynamic RAM, a floppy disk and associated disk drive, a writeable or re-writeable optical disk and associated disk drive, a hard drive/memory, and/or any other like memory and/or device. Similarly, the non-alterable of fixed memory can be implemented using any one or more of ROM, PROM, EPROM, EEPROM and optical ROM disk, such as a CD-ROM or DVD-ROM disk and compatible disk drive or any other like memory storage medium and/or device.

The above detailed description of exemplary embodiments of systems and methods for defining a dynamic sensor positioner system in an image forming device is meant to be illustrative and in no way limiting. The above detailed description of systems and methods is not intended to be exhaustive or to limit this disclosure to any precise embodiments or feature disclosed. Modifications and variations are possible in light of the above teaching. The above embodiments were chosen in order to clearly explain the principles of operation of the systems and methods according to the disclosure and their practical application to enable others skilled in the art to utilize various embodiments, potentially with various modifications, suited to a particular use contemplated. Also, various presently unforeseen or unanticipated alternatives, modifications, variations or improvements therein may be subsequently made by those skilled in the art, and are also intended to be encompassed by the following claims.

What is claimed is:

1. A system for establishing a dynamic sensor positioner system in a color image forming device, comprising:

a photoreceptor drum;

a carriage movably mounted to a frame;

a sensor fixedly attached to the carriage;

a drive shaft that moves the carriage relative to the frame;

a guide rod that guides the carriage as the carriage is moved by the drive shaft, the guide rod having a plurality of grooves that correspond substantially to a plurality of predetermined positions;

a controller that determines the positioning of the carriage in relation to the photoreceptor drum; and a handle attached to the cartridge that moves along the guide rod, wherein the sensor is for electrostatic control, the plurality of predetermined positions correspond substantially to the locations of color control patches, and the handle will positively engage at least one of the plurality of grooves adjacent the color control patches locking the handle into position.

2. The system of claim 1, further comprising a position determination unit that determines that the carriage be moved to the plurality of predetermined positions.

3. A system for establishing a dynamic sensor positioner system in a color image forming device, comprising:

a photoreceptor drum;

a carriage movably mounted to a frame;

a sensor fixedly attached to the carriage;

a controller that determines the positioning of the carriage in relation to the photoreceptor drum;

a position determination unit that determines that the carriage be moved to a plurality of predetermined positions;

a drive shaft that moves the carriage relative to the frame to the plurality of predetermined positions;

a guide rod that guides the carriage as the carriage is moved by the drive shaft; and a back plate to which a plurality of rods are attached by a first end, wherein the plurality of rods have a second end, opposite the first end, that correspond to the predetermined positions, the drive shaft is a high pitched helix shaft, and the high pitched helix shaft is rotated manually by a user.

4. The system of claim 3, wherein the predetermined positions are disposed substantially adjacent to the locations of color control patches.

5. The system of claim 1, wherein the color image forming device is a xerographic image producing device.

6. The system of claim 1, wherein the drive shaft is a high pitched helix shaft.

7. The system of claim 6, wherein the high pitched helix shaft is rotated manually by a user.

8. The system of claim 6, wherein the high pitched helix shaft is rotated by a servo-motor.

9. The system of claim 3, wherein the sensor is for electrostatic control.

10. The system of claim 3, wherein the controller moves the sensor to be in contact with one of the second ends thereby positioning the sensor at one of the predetermined locations.

* * * * *